US005491042A

United States Patent [19]

Sato et al.

[11] Patent Number: 5,491,042

[45] Date of Patent: Feb. 13, 1996

[54] METHOD FOR MANUFACTURING A RESIN-COATED CARRIER FOR AN ELECTROPHOTOGRAPHIC DEVELOPER

[75] Inventors: Yuji Sato; Toshiyuki Fukumoto; Yoshifumi Imamura; Toshio Honjo, all of Kashiwa, Japan

[73] Assignee: Powdertech Co., Ltd., Kashiwa, Japan

[21] Appl. No.: 283,249

[22] Filed: Jul. 29, 1994

Related U.S. Application Data

[63] Continuation-in-part of Ser. No. 13,683, Feb. 4, 1993, abandoned.

[30] Foreign Application Priority Data

Feb. 7, 1992 [JP] Japan ..... 4-056730

[51] Int. Cl.[6] ..... G03G 9/113

[52] U.S. Cl. ..... 430/108; 430/137

[58] Field of Search ..... 430/108, 137

[56] References Cited

U.S. PATENT DOCUMENTS 4,692,359 9/1987 Fitzpatrick ..... 430/42

5,340,677 8/1994 Baba et al. ..... 430/108

*Primary Examiner*—John Goodrow

*Attorney, Agent, or Firm*—Bucknam and Archer

[57] ABSTRACT

This invention provides a method for manufacturing a resin-coated carrier for an electrophotographic developer comprising the steps of coating the surface of a carrier core which is a dielectric material, with a resin which is also a dielectric material and then baking the thus obtained resin coated carrier core by means of microwave heating under the conditions that a thickness of the resin-coated carrier layer to be baked is in the range of from 5 to 25 mm, the number of revolution of agitating blade for agitating the microwave is in the range of from 20 to 40 rpm and an irradiation time is in the range of from 30 seconds to 10 minutes, to obtain the resin-coated carrier. The resin-coated carriers are characterized by having an excellent durability, excellent resistance to the environment, as well as excellent producibility and economy.

12 Claims, No Drawings

METHOD FOR MANUFACTURING A RESIN-COATED CARRIER FOR AN ELECTROPHOTOGRAPHIC DEVELOPER

This application is a Continuation-In-Part of U.S. Ser. No. 08/013,683, filed Feb. 4, 1993, now abandoned.

BACKGROUND OF THE INVENTION

1. Field of the Invention

The present invention relates to a method for manufacturing a resin-coated carrier for an electrophotographic developer for use in a copying machine, a printer or the like, and to an electrophotographic developer using therein the carrier obtained by said method.

2. Prior Art

A two-component type developer used for electrophotography is composed of a toner and a carrier. When the developer is used, the carrier is stirred and mixed with the toner in a development box to give a desired charge to the toner and then carries the thus charged toner onto electrostatic latent images on a photosensitive material to develop the latent images so as to form toner images. The carrier thus used remains on a magnet roll and is then returned again to the development box when it is again stirred and mixed with a fresh toner for repeated use in a developer.

Accordingly, the carrier is required to always provide the toner with the desired charge during the use of the carrier.

Further, in substitution for many carriers, there has recently been generally used a resin-coated carrier prepared by coating the surface of a carrier core with various resins to obtain a carrier which is improved in durability and resistance to environmental dependence.

However, conventional developers which have heretofore been used will cause various inconveniences with respect to images developed, due to collision of carrier particles with each other by stirring, or friction between the development box and the carrier particles. One of the inconveniences is that the toner particles are fusion adhered onto the surface of the carrier particles by friction to cause useless consumption of the toner (the useless consumption being hereinafter refered to as "spent"-phenomenon) so that the distribution of charge amount between the toner and carrier is widened with the result that toner scattering and image fog arise during the use of the developer for testing the service life thereof. Further, in the case in which a resin-coated carrier is included instead of the above carrier in the developer, the resin of the outermost layer of the coated resin falls off to expose the internal resin layer so that the charge amount between the toner and carrier is varied with the result that such toner scattering and image fogging as above arise especially under high-temperature and high-humidity conditions, during the use of the developer. When the developer service life test is further conducted, the resin layer is peeled off to expose the carrier core so that the carrier resistance is varied with the result that the developer cannot maintain its performance of making images which are substantially equal to the initially made image and it finally ends its service life.

In the case in which a developer including the resin-coated carrier is used, a "spent"-phenomenon with the toner tends to decrease as compared with the use of the uncoated carrier in the developer. However, the so-called granulation of the resin-coated carrier particles arises due to the carrier core particles being adhered to one another with the resin at the time of resin coating. The granulated resin-coated carrier particles are then separated one by one from one another so that the fluidity of the developer during printing or copying, is varied with the result that the toner concentration is varied, the density of imagees to be obtained decreases due to the toner scattering caused by excessive concentration of the toner and to lessening of the toner density, and image deficiencies are very often incurred by adhesion of the carrier particles to the image.

There have heretofore been proposed various resin-coated carriers in order to improve carriers in durability. For example, there have been proposed carriers prepared by coating carrier cores on the surface with a fluorocarbon-based polymer (for example, Japanese Patent Application Laid-Open Gazette No. Sho. 54-126,040). Although the resin-coated carrier so proposed was stable in charging characteristics initially, it allowed a developer containing it to vary in fluidity due to the use of the carrier for a long time thereby forming images having insufficient density, impairing a photosensitive material due to adhesion of the carrier thereto and consequently incurring defects as to images, thus the resin-coated carrier having been overall estimated to have a short service life.

Further, carriers coated with a silicone resin or the like have been proposed (Japanese Patent Application Laid Open Gazette No. Sho. 57-78,552, etc.). This silicone resin-coated carrier has an advantage that the use makes it difficult to cause a "spent"-phenomenon because of its low-surface energy. However, it causes fogging and toner scattering due to its gradual decrease in charge level with the result that a developer having the silicone resin-coated carrier has a short service life.

Recently, a carrier has been required to have satisfactory durability and a developer including such a carrier is ultimately required to be maintenance-free for use, as mentioned above. However, the service life of the resin-coated carrier is still short and, therefore, there has remained an outstanding problem as to difficulties in prolonging the service life of a developer containing such a carrier. Further, there has also remained a problem as to a still high cost for coating a carrier core with a resin.

Most of the conventional heating methods involve an external heating system so that when the resin-coated carrier is heated by way of combustion flame, heated air, burner, electric heater, or hot steam, it is slowly heated from the outermost resin layer thereof down to the core material through heat conduction.

Therefore, the resin thus molten in the outermost layer is fused to each other thereby forming granules, and it takes a lot of time to sufficiently heat a portion inner than the resin layer or the core material. Further, due to these reasons, a difference in curing between the inner resin and outer resin, or a loosening of adherence between the resin and the core material may be caused to occur, so that the resin is likely to be peeled off, and the service life of the developer is shortened.

Moreover, the conventional external heating system is also defective in that the baking time is rather long, and the manufacturing cost is high.

The present invention was made to solve the problems of the above mentioned prior art, and an object of the present invention is to provide a method for manufacturing resin-coated carriers for an electrophotographic developer which are excellent in durability, resistance to environment without changing their electrifiability for the toner, and producibility, as well as in economy, and also to provide an electrographic developer including the carrier obtained by said method.

SUMMARY OF THE INVENTION

The present inventors made various intensive studies to make sure what factors constitute a bar to solving the above problems and, as the result of their studies, they found that the occurrence of peeling of the resin of the resin-coated carrier and the granulation thereof are the biggest factors. As the result of their further studies, they also found that a further significant factor is the method for heating a resin coated on a carrier core in the process of preparation of the resin-coated carrier. The present invention is based on this finding.

The method for manufacturing a resin-coated carrier for an electrophotographic developer of the present invention is characterized in that it comprises the steps of coating the surface of a carrier core which is a dielectric material, with a resin which is also a dielectric material and then baking the thus obtained resin coated carrier core under the conditions that a thickness of the resin-coated carrier layer to be baked is in the range of from 5 to 25 mm, a revolution number of agitating blade for agitating the microwave is in the range of from 24 to 36 rpm and an irradiation time is in the range of from 30 seconds to 10 minutes by means of microwave heating, to obtain the resin-coated carrier.

DETAILED EXPLANATION OF THE INVENTION

The present invention will now be explained hereunder in more detail.

The carrier core to be used in the present invention is a dielectric material. Examples thereof are ferrite, magnetite and ceramics, among which ferrite is preferred and Cu—Zn ferrite is particularly preferred. Therefore, since metals such as iron and copper are not dielectric materials, they cannot be used in the present invention. The mean particle diameter of the carrier core is in the range of 15 to 200 μm, preferably 20 to 150 μm. When the mean particle diameter of a carrier used is less than 15 μm, the carrier will exhibit severe adhesion. On the other hand, when the mean particle diameter of a carrier is larger than 200 μm, the density of solid area of the resulting image will be deficient.

In the present invention, the surface of the carrier core which is a dielectric material is coated with a desired synthetic resin.

The resins to be used in the present invention are not particularly limited, and examples thereof are fluorine-based resins, silicone-based resins, acryl-styrene resins, alkyd resins, polyolefin resins, polyester resins and epoxy resins, and mixtures thereof.

In addition to the above, the typical usable resins include fluorine-based resins such as polyvinylidene fluoride and vinylidene fluoride/tetrafluoroethylene copolymers; silicone-based resins such as cold-setting and thermosetting silicone resins which are used in the form of silicone varnish, and silane coupling agents of low-degree polymerization; acryl/styrene-based resins such as acryl-based resins alone, styrene-based resins alone, and copolymers of acryl-based monomer and styrene-based monomer, the acryl-based resins used herein referring to acrylic or methacrylic acid homopolymers, copolymers of said acid and other monomer, homopolymers of acrylic or methacrylic acid ester having functional groups, copolymers of said ester with other monomer; and each of these polymers, into which is introduced a thermosetting resin such as a melamine resin, or an isocyanate compound. Among these resins, acryl-based resins are the best from the standpoint of adhesion to the carrier cores.

The amount of such a resin coated is preferably 0.05 to 10.0% by weight, more preferably 0.1 to 7.0% by weight, of the resulting resin-coated carrier. When the amount of the resin used is less than 0.05% by weight, a uniform coating layer cannot be formed on the carrier surface. When the amount of the resin used is more than 10.0% by weight, the resulting coating layer will be too thick and the resulting resin-coated carrier particles will be remarkably granulated even if they are baked by microwave heating.

In order to adjust charges and resistivities, conductive materials such as carbon black may be added to the above resins.

In the present invention, the resin is generally dissolved in a solvent and then coated on the surface of the carrier core. The solvents used herein may be ones which can easily dissolve the resins therein, and examples thereof are toluene, xylene, cellosolve butyl acetate, methyl ethyl ketone, methyl isobutyl ketone and methanol. The resin diluted in the solvent may be applied by any method such as a dipping method, spray method, brushing method or kneading method, and the solvent so applied is then volatilized in the air.

Furthermore, the surface of the carrier core may be coated with the resin by a dry method instead of a wet method using the solvent.

The heating method employed in this invention is an internal heating method by means of a high frequency heating. This heating method is suited for heating a dielectric material in a short time, but is considered to be unsuited for uniformly heating the material. In particular, if this heating is applied to a carrier, which is an aggregate of fine particles 15 to 200 μm in diameter, non-uniform resin covering layer may be caused to formed. Namely, part of the carrier may become a soft and non-durable resin layer due to a residual solvent, and another part of the carrier may be so heated that part of the resin may be cracked to become brittle, thereby forming a resin-coated carrier which is poor in durability as a developper.

The inventors have found after profound studies that in order to allow a ferrite carrier having the ordinary size of 15 to 200 μm in diameter to be uniformly irradiated with a microwave, the resin layer covering the carrier should be uniform and 5 to 25 μm in thickness, and the number of revolutions of the agitating blade for agitating the microwave should be controlled to 20 to 40 rpm, preferably 24 to 36 rpm.

In a case where the thickness of the resin layer to be baked is less than 5 mm, it is not preferable in productivity and in economy since productive facilities such as belt and the like to convey the resin-coated carrier is likely to deteriorated in continuous operation. On-the other hand, in a case where the thickness of the resin layer is more than 25 mm, it is not preferable since the microwave does not uniformly travel to the resin layer and temperature distribution results in wide.

In addition, in a case where the number of the revolutions of the agitating blade is less than 20 rpm, it is not preferable since temperature distribution of the baked carrier layer after irradiation results wide and the resulting carrier layer results with unevenness of baking. On the other hand, in a case where the number of the revolutions is more than 40 rpm, it is not preferable in efficiency since the resin layer cannnot effectively be irradiated by the microwave due to over-agitating. Moreover, an angle of the agitating blade for agitating the microwave can arbitrarily be changed so as to efficiently irradiate the microwave.

Since the inner heating method which is the main feature of this invention is a heating method wherein a material to be heated functions as a heater element, heat can be transferred uniformly and instantly from the core of the carrier or inside of the resin layer to the exterior, so that the adherence of the resin layer to the core material of carrier can be remarkably improved.

Further, due to the employment of the microwave heating method in this invention, it has become possible to carry out the baking within a short period of time, thus decreasing the manufacturing cost and enhancing the productivity.

In the present invention, the micro-wave heating is applied to the resin, which is a dielectric material, coated on the surface of a carrier core, thereby baking the resin thereon. In this case, it is necessary to heat the coated resin to a temperature higher than that at which the resin is cured by the use of microwave heating, and, to this end, it is also necessary to adjust a time for irradiating the microwave. The irradiation time is generally from 30 seconds to 10 minutes.

When the irradiation time is shorter than 30 seconds, the adhesion of the resin to the carrier core is poor since the amount of heat applied is insufficient. On the other hand, when the irradiation time is longer than 10 minutes, the durability of the resin-coated carrier is deteriorated since the resin is overheated thereby causing the decomposition thereof.

The microwave used for microwave heating in the present invention is among electromagnetic waves having a frequency ranging from 300 MHz to 30 GHz and has a frequency of 915±25 MHz or 2450±50 GHz with the latter being prefered.

In the above manner, the resin is coated on the surface of the carrier core, baked (or cured) and then cooled to obtain a resin-coated carrier.

FUNCTION

Conventional heating used at the time of coating carrier cores with a resin has been effected by flame and heated air originated from combustion, a burner, an electric heater or vapor or the like. These heating means have been used to heat the external surface of the thus coated resin by their heat irradiation from the outside and then heat the inside, that is the carrier core, by thermal conductivity. In brief, conventional heating is external heating.

In contrast, the present invention adopts an internal heating method using high-frequency heating (radio heating), in which method the material to be heated generates heat from itself (from the carrier cone in this case) as a heating medium. This internal heating will enable the adhesion of the resin layer to carrier core to be improved or enhanced since the resin and the carrier core themselves generate heat uniformly from their insides. Further, the microwave heating system will enable resin coatings to be baked in a short time.

Thus, the conventional heating apparatus needs a longer baking time and a higher cost to manufacture resin-coated carriers, while the present invention makes it possible to remarkably shorten the baking time as compared with the conventional one, reduce their production cost and render their producibility excellent.

The present invention will be better understood by the following Examples and Comparative Examples.

EXAMPLE 1

Cu—Zn ferrite particles (produced under the tradename "F-150" by Powdertech Co., Ltd., Japan; mean particle diameter: 80 μm; saturation magnetization: 65 emu/g) were used as a carrier core. On the other hand, 88% by weight of an acryl-styrene based resin and 12% by weight of a melamine based resin were dissolved in toluene solvent to prepare a coating resin composition. The thus prepared coating composition was coated on the carrier core by using a fluidized-bed so that the resin so coated amounted to 3.0% by weight based on the total weight of the resulting resin-coated carrier. The thus coated carrier core was then baked under the conditions of revolution of agitating blade being 25 rpm and thickness of carrier layer to be baked being 13±2 mm for 3 minutes by irradiating a microwave having a wavelength of 2450 MHz by using a microwave heating apparatus, to obtain a resin-coated carrier. The temperature of the coated carrier at the time of irradiation was 150°±5° C.

These characteristics at the resin-coated carriers obtained and treating conditions used in Examples and Comparative Examples are summarized in Table 1.

The resin-coated carrier obtained in Example 1 and a toner were used to prepare a developer which was then subjected to a developer service life test in which 500,000 sheets were to be copied by a commercially available copying machine to test the resin-coated carrier for its image evaluation. The toner used in this test was a commercially available black toner and the toner concentration used was 4.5% by weight.

The image evaluation was effected for image density, for on the image, carrier adhesion and toner scattering which were observed at the initial stage of this developer service life test and after the end thereof, as well as for environmental variation of electric charge, resistance variation of the carrier and amount of "spent", after which an overall estimation was carried out. The test results are shown in the following table 2. In Table 2, the symbols, ⊙, ○, Δ, and X represent "excellent", "good", "slightly poor" and "poor", respectively. Methods for evaluating these items are indicated hereunder.

Image Evaluation of Carrier (1) Image density (ID)

The developer was used in copying under a proper exposure condition to obtain copies which were then evaluated for image density. More particularly, the initial and final test copies were evaluated at their solid image portions for image density by using a SAKURA densitometer, and the image densities found were ranked.

(2) Fog on image

As for fogs on the image, test copies were evaluated at their white grounds for toner fog on the image, and the fogs found were ranked.

(3) Carrier adhesion

As in the case of the above toner fog, test copies were evaluated at their white grounds for carrier adhesion level, and the levels found were ranked.

(4) Toner scattering

Test copies were eveluated for degree of toner scattering which stains the copies, soil of an electrification charger and undesirable condition of toner scattering, and these results found were then ranked.

(5) Environmental variation of charge

One portion of the developer was maintained at 10° C. and 15% humidity for 24 hours to find its amount of charge (QLL) at the end of the maintenance, while another portion of the same developer was also maintained at 30° C. and 85% humidity for 24 hours to find its amount of charge (QHH) at the end of said maintenance. The difference (ΔQ) was calculated and ranked for evaluating environmental variation of charge.

$$\Delta Q = QLL - QHH(\mu c/g)$$

(6) Carrier resistance variation

The inherent resistance (R1) of the resin-coated carrier at the initial stage and that (R2) thereof after the end of the developer service life test of copying 500,000 sheets were measured respectively, and the difference (ΔR) therebetween was calculated from the said resistances found. The variation of the carrier resistance was evaluated by ranking the difference thus obtained.

$$\Delta R = R_1 - R_2(\Omega.\text{cm})$$

(7) Amount of "spent"

The amount of toner (amount of "spent") adhered to the carrier after the end of the developer service life test of copying 500,000 sheets was measured and ranked for evaluating the amount of "spent".

(8) Overall evaluation

The image evaluations (image density, fog on the image, carrier adhesion, toner scattering, environmental variation of electrification or charge, carrier resistance variation and amount of "spent") obtained in the developer service life test of 500,000 sheets were overall evaluated and ranked.

EXAMPLE 2

Cu—Zn ferrite particles (produced under the tradename "FL-100" by Powdertech Co., Ltd., Japan; mean particle diameter: 120 μm; saturation magnetization: 55 emu/g) were used as a carrier core. On the other hand, a silicone resin (produced under the tradename "SR- 2411" by the Toray-Dow Corning silicone Co., Ltd.,) was coated in the same manner as in Example 1 so that said resin was coated in an amount of 1.0% by weight based on the total weight of the resulting resin-coated carrier. Furthermore, the thus obtained coated carrier core was baked under the conditions of revolution of agitating blade being 30 rpm and thickness of carrier layer to be baked being 13±2 mm for 6 minutes by irradiating thereto a microwave having a wavelength of 2450 MHz by using a microwave heating apparatus to obtain a resin-coated carrier. The temperature of the coated carrier at the time of irradiation was 200°± 5° C.

The characteristics at the carrier core used in this Example and treating conditions are summarized in Table 1.

A developer was prepared from the thus obtained resin-coated carrier and the same toner as used in Example 1 so that the toner concentration was 4.0% by weight. The thus obtained developer was subjected to a developer service life test under the same conditions as Example 1 by using a commercially available copying machine to conduct image evaluation. The image evaluation in this case is shown in table 2.

EXAMPLE 3

Cu—Zn Ferrite particles (produced under the tradename "F-1030" by Powdertech Co., Ltd., Japan; mean particle diameter: 100 μm; saturation magnetization: 65 emu/g) were used as a carrier core, On the other hand, a fluorine-acryl resin (1:1 mixed resin of polyvinylidene fluoride and acryl-styrene resin) was coated in the same manner as in Example 1 so that said resin was coated in an amount of 0.3% by weight based on the total weight of the resulting resin-coated carrier. Furthermore, the thus obtained coated carrier core was baked under the conditions of revolution of agitating blade being 35 rpm and thickness of carrier layer to be baked being 13±2 mm for 4 minutes by irradiating thereto a microwave having a wavelength of 2450 MHz by using a microwave heating apparatus to obtain a resin-coated carrier. The temperature of the coated carrier at the time of irradiation was 170°± 5° C.

The characteristics at the carrier core used in this Example and treating conditions are summarized in Table 1.

A developer was prepared from the thus obtained resin-coated carrier and the same toner as used in Example 1 so that the developer had a toner concentration of 4.0% by weight. The thus obtained developer was subjected to a developer service life test under the same conditions as Example 1 by using a commercially available copying machine to carry out image evaluation of the resin-coated carrier. The image evaluation in this case is shown in Table 2.

EXAMPLE 4

Cu—Zn ferrite particles (produced under the tradename "F-150" by Powdertech Co., Ltd., Japan; mean particle diameter: 80 μm; saturation magnetization: 65 emu/g) were used as a carrier core. On the other hand, 88% by weight of an acryl-styrene based resin and 12% by weight of a melamine based resin were dissolved in a toluene solvent to prepare a coating resin composition, and said carrier core was coated with said resin composition in the same manner as in Example 1 so that said resin was coated in an amount of 8.0% by weight based on the total weight of the resulting resin-coated carrier. Furthermore, the thus obtained coated carrier core was baked under the conditions of revolution of agitating blade being 25 rpm and thickness of carrier to be baked layer being 15±2 mm for 6 minutes by irradiating thereto a microwave having a wavelength of 915 MHz by using a microwave heating apparatus to obtain a resin-coated carrier. The temperature of the coated carrier at the time of irradiation was 150°±5° C.

The characteristics at the carrier core used in this Example and treating conditions are summarized in Table 1.

A developer was prepared from the thus obtained resin-coated carrier and the same toner as used in Example 1 so that the developer had a toner concentration of 4.5% by weight. The thus obtained developer was subjected to a developer service life test under the same conditions as Example 1 by using a commercially available copying machine to conduct image evaluation of the resin-coated carrier. The image evaluation in this case was shown in Table 2.

COMPARATIVE EXAMPLE 1

The procedure of Example 1 was followed except that baking of the resin at 150° C. for 60 minutes in an electric furnace was substituted for the microwave heating at 150° C. for 3 minutes, to obtain a comparative resin-coated carrier. The temperature of the coated carrier at the time of heating in the electric furnace was 150°±5° C.

The characteristics at the carrier core used in this Comparative Example and treating conditions are summarized in Table 1.

A developer was prepared from the thus obtained resin coated carrier and the same toner as used in Example 1 so that the developer had a toner concentration of 4.5% by weight of a toner concentration. The thus obtained developer was subjected to a developer service life test under the same conditions as Example 1 by using a commercially available copying machine to conduct image evaluation of the resin-coated carrier. The image evaluation in this case is shown in Table 2.

COMPARATIVE EXAMPLE 2

The procedure of Example 2 was followed except that baking of the resin at 200° C. for 120 minutes in a thermostat was substituted for the microwave heating at 200° C. for 6 minutes, to obtain a comparative resin-coated carrier. The temperature of the coated carrier at the time of heating in the thermostat was 200°±5° C.

The characteristics at the carrier core used in this Comparative Example and treating conditions are summarized in Table 1.

A developer was prepared from the thus obtained resin-coated carrier and the same toner as used in Example 1 so that the developer had a toner concentration of 4.0% by weight. The thus obtained developer was subjected to a developer service life test under the same conditions as Example 1 by using a commercially available copying machine to conduct image evaluation of the resin-coated carrier. The image evaluation in this case is shown in Table 2.

COMPARATIVE EXAMPLE 3

The procedure of Example 3 was followed except that baking of the resin at 170° C. for 90 minutes in an the electric furnace was substituted for the microwave heating at 170° C. for 4 minutes, to obtain a comparative resin-coated carrier. The temperature of the coated carrier at the time of heating in the electric furnace was 170°±5° C.

The characteristics at the carrier core used in this Comparative Example and treating conditions are summarized in Table 1.

A developer was prepared from the thus obtained resin-coated carrier and the same toner as used in Example 1 so that the developer had a toner concentration of 4.0% by weight. The thus obtained developer was subjected to a developer service life test under the same conditions as Example 1 by using a commercially available copying machine to carry out image evaluation of the comparative resin-coated carrier. The image evaluation in this case was shown in Table 2.

COMPARATIVE EXAMPLE 4

The procedure of Example 4 was followed except that baking of the resin at 150° C. for 60 minutes in an the electric furnace was substituted for the microwave heating at 150° C. for 6 minutes, to obtain a comparative resin-coated carrier. The temperature of the coated carrier at the time of heating in the electric furnace was 150°±5° C.

The characteristics at the carrier core used in this Comparative Example and treating conditions are summarized in Table 1.

A developer was prepared from the thus obtained comparative resin-coated carrier and the same toner as used in Example 1 so that the developer had a toner concentration of 4.5% by weight. The thus obtained developer was subjected to a developer service life test under the same conditions as Example 1 by using a commercially available copying machine to carry out image evaluation of the comparative resin-coated carrier. The image evaluation in this case is shown in table 2.

COMPARATIVE EXAMPLE 5

The procedure of Example 1 was followed except that revolution of agitating blade was stopped, to obtain a comparative resin-coated carrier. The temperature of the coated carrier at the time of irradiation was 150°±15° C.

The characteristics at the carrier core used in this Comparative Example and treating conditions are summarized in Table 1.

A developer was prepared from the thus obtained resin coated carrier and the same toner as used in Example 1 so that the developer had a toner concentration of 4.5% by weight. The thus obtained developer was subjected to a developer service life test under the same conditions as Example 1 by using a commercially available copying machine to conduct image evaluation of the resin-coated carrier. The image evaluation in this case is shown in Table 2.

COMPARATIVE EXAMPLE 6

The procedure of Example 2 was followed except that revolution of agitating blade was stopped, to obtain a comparative resin-coated carrier. The temperature of the coated carrier at the time of irradiation was 200°±20° C.

The characteristics at the carrier core used in this Comparative Example and treating conditions are summarized in Table 1.

A developer was prepared from the thus obtained resin coated carrier and the same toner as used in Example 1 so that the developer had a toner concentration of 4.0% by weight. The thus obtained developer was subjected to a developer service life test under the same conditions as Example 1 by using a commercially available copying machine to conduct image evaluation of the resin-coated carrier. The image evaluation in this case is shown in Table 2.

COMPARATIVE EXAMPLE 7

The procedure of Example 3 was followed except that revolution of agitating blade was stopped, to obtain a comparative resin-coated carrier, The temperature of the coated carrier at the time of irradiation was 170°±15° C.

The characteristics at the carrier core used in this Comparative Example and treating conditions are summarized in Table 1.

A developer was prepared from the thus obtained resin coated carrier and the same toner as used in Example 1 so that the developer had a toner concentration of 4.0% by weight. The thus obtained developer was subjected to a developer service life test under the same conditions as Example 1 by using a commercially available copying machine to carry out image evaluation of the comparative resin-coated carrier. The image evaluation in this case was shown in Table 2.

COMPARATIVE EXAMPLE 8

The procedure of Example 4 was followed except that revolution of agitating blade was stopped, to obtain a comparative resin-coated carrier. The temperature of the coated carrier at the time of irradiation was 150°±15° C.

The characteristics at the carrier core used in this Comparative Example and treating conditions are summarized in Table 1.

A developer was prepared-from the thus obtained resin coated carrier and the same toner as used in Example 1 so that the developer had a toner concentration of 4.5% by weight. The thus obtained developer was subjected to a developer service life test under the same conditions as Example 1 by using a commercially available copying machine to carry out image evaluation of the comparative resin-coated carrier. The image evaluation in this case is shown in table 2.

COMPARATIVE EXAMPLE 9

The procedure of Example 2 was followed except that revolution of agitating blade was stopped and the thickness of carrier layer was changed to 35±3 mm, to obtain a comparative resin-coated carrier. The temperature of the coated carrier at the time of irradiation was 190°±20° C.

The characteristics at the carrier core used in this Comparative Example and treating conditions are summarized in Table 1.

A developer was prepared from the thus obtained resin coated carrier and the same toner as used in Example 1 so that the developer had a toner concentration of 4.0% by weight. The thus obtained developer was subjected to a developer service life test under the same conditions as Example 1 by using a commercially available copying machine to conduct image evaluation of the resin-coated carrier. The image evaluation in this case is shown in Table 2.

COMPARATIVE EXAMPLE 10

The procedure of Example 2 was followed except that revolution of agitating blade was changed to 10 rpm and the thickness of carrier layer was changed to 30±3 mm, to obtain a comparative resin-coated carrier. The temperature of the coated carrier at the time of irradiation was 200°±10° C.

The characteristics of the carrier core used in this Comparative Example and treating conditions are summarized in Table 1.

A developer was prepared from the thus obtained resin coated carrier and the same toner as used in Example 1 so that the developer had a toner concentration of 4.0% by weight. The thus obtained developer was subjected to a developer service life test under the same conditions as Example 1 by using a commercially available copying machine to conduct image evaluation of the resin-coated carrier. The image evaluation in this case is shown in Table 2.

TABLE 1

| Examp. * Comp. Ex. | mean particle diameter (μm) | saturation magnetization (emu/g) | coated resin | amount of resin coated (wt %) | baking conditions: apparatus used | product temp. (°C.) | time (min.) | wave-length (MHz) | revolution of agitating blade (rpm) | width of carrier layer (mm) |
|---|---|---|---|---|---|---|---|---|---|---|
| Ex. 1 | 80 | 65 | A-S*1 | 3.0 | MW*4 | 150 ± 5 | 3 | 2450 | 25 | 13 ± 2 |
| Ex. 2 | 120 | 55 | Si*2 | 1.0 | MW*4 | 200 ± 5 | 6 | 2450 | 30 | 13 ± 2 |
| Ex. 3 | 100 | 65 | F-A*3 | 0.3 | MW*4 | 170 ± 5 | 4 | 2450 | 35 | 13 ± 2 |
| Ex. 4 | 80 | 65 | A-S*1 | 8.0 | MW*4 | 150 ± 5 | 6 | 915 | 25 | 15 ± 2 |
| Comp. 1 | 80 | 65 | A-S*1 | 3.0 | EF*5 | 150 ± 5 | 60 | — | — | 13 ± 2 |
| Comp. 2 | 120 | 55 | Si*2 | 1.0 | TH*6 | 200 ± 5 | 120 | — | — | 13 ± 2 |
| Comp. 3 | 100 | 65 | F-A*3 | 0.3 | EF*5 | 170 ± 5 | 90 | — | — | 13 ± 2 |
| Comp. 4 | 80 | 65 | A-S*1 | 8.0 | EF*5 | 150 ± 5 | 60 | — | — | 15 ± 2 |
| Comp. 5 | 80 | 65 | A-S*1 | 3.0 | MW*4 | 150 ± 15 | 3 | 2450 | 0 | 13 ± 2 |
| Comp. 6 | 120 | 55 | Si*2 | 1.0 | MW*4 | 200 ± 20 | 6 | 2450 | 0 | 13 ± 2 |
| Comp. 7 | 100 | 65 | F-A*3 | 0.3 | MW*4 | 170 ± 15 | 4 | 2450 | 0 | 13 ± 2 |
| Comp. 8 | 80 | 65 | A-S*1 | 8.0 | MW*4 | 150 ± 15 | 6 | 915 | 0 | 15 ± 2 |
| Comp. 9 | 120 | 55 | Si*2 | 1.0 | MW*4 | 190 ± 20 | 6 | 2450 | 0 | 35 ± 3 |
| Comp. 10 | 120 | 55 | Si*2 | 1.0 | MW*4 | 200 ± 10 | 6 | 2450 | 10 | 30 ± 3 |

Note
*1: acryl-styrene,
*2: silicone,
*3: fluorine-acryl,
*4: microwave,
*5: electric furnace,
*6: thermostat

TABLE 2

| Examp. * Comp. Ex. | image density test *1 | test *2 | test *3 | fogging on the image test *1 | test *2 | test *3 | carrier adhesion test *1 | test *2 | test *3 | toner scattering test *1 | test *2 | test *3 | Environmental variation of charge | resistivity fluctuation of carrier | amount of "spent" | overall evaluation |
|---|---|---|---|---|---|---|---|---|---|---|---|---|---|---|---|---|
| Ex. 1 | ◎ | ◎ | ◎ | ◎ | ◎ | ◎ | ◎ | ◎ | ◎ | ◎ | ◎ | ◎ | ◎ | ◎ | ○ | ◎ |
| Ex. 2 | ◎ | ◎ | ◎ | ◎ | ◎ | ◎ | ◎ | ◎ | ◎ | ◎ | ◎ | ○ | ○ | ○ | ◎ | ◎ |

TABLE 2-continued

| Examp. * | image density | | | fogging on the image | | | carrier adhesion | | | toner scattering | | | Environ-mental varia- | resis-tivity fluctua- | amount | overall |
|---|---|---|---|---|---|---|---|---|---|---|---|---|---|---|---|---|
| Comp. Ex. | test *1 | test *2 | test *3 | test *1 | test *2 | test *3 | test *1 | test *2 | test *3 | test *1 | test *2 | test *3 | tion of charge | tion of carrier | of "spent | evalua-tion |
| Ex. 3 | ◎ | ◎ | ◎ | ◎ | ◎ | ◎ | ◎ | ◎ | ◎ | ◎ | ◎ | ◎ | ◎ | ○ | ○ | ◎ |
| Ex. 4 | ◎ | ◎ | ○ | ◎ | ◎ | ○ | ◎ | ◎ | ○ | ◎ | ◎ | ○ | ○ | ○ | ○ | ○ |
| Comp. 1 | ◎ | ○ | X | ○ | ○ | X | ◎ | ○ | X | Δ | Δ | X | Δ | X | X | X |
| Comp. 2 | ◎ | ○ | X | ○ | ○ | X | ◎ | ○ | X | Δ | X | X | X | X | Δ | X |
| Comp. 3 | ○ | ○ | X | ○ | ○ | X | ◎ | ○ | X | Δ | X | X | Δ | X | X | X |
| Comp. 4 | ○ | ○ | X | ○ | ○ | X | ◎ | ○ | X | Δ | X | X | Δ | X | X | X |
| Comp. 5 | ◎ | ◎ | Δ | ◎ | ◎ | ○ | ◎ | ◎ | Δ | ◎ | ◎ | Δ | Δ | Δ | Δ | Δ |
| Comp. 6 | ◎ | ◎ | ○ | ◎ | ◎ | Δ | ◎ | ◎ | Δ | ◎ | ○ | Δ | Δ | Δ | ○ | Δ |
| Comp. 7 | ◎ | ◎ | Δ | ◎ | ◎ | ○ | ◎ | ◎ | Δ | ◎ | ○ | Δ | Δ | Δ | Δ | Δ |
| Comp. 8 | ◎ | ○ | Δ | ◎ | ○ | Δ | ◎ | ○ | Δ | ◎ | ○ | X | Δ | Δ | X | Δ |
| Comp. 9 | ◎ | ○ | ○ | ◎ | ○ | Δ | ◎ | ○ | X | ◎ | ○ | X | X | X | Δ | X |
| Comp. 10 | ◎ | ◎ | ◎ | ◎ | ◎ | Δ | ◎ | ○ | Δ | ◎ | ○ | Δ | Δ | Δ | ○ | Δ |

*1: represents the results of initial stage.
*2: represents the results after 100,000 sheets are copied.
*3: represents the results after 500,000 sheets are copied.

EFFECT OF THE INVENTION

The resin-coated carriers obtained by the method of the present invention have excellent advantages that the "spent"-phenomenon (amount of "spent") of the toner appreciated on hardening or cutting the coated resin is very slight since the adhesion between the carrier core and the resin becomes firm and steady due to the internal heating by using microwave heating in the baking step after the carrier core was coated with the resin, and they also have excellenet durability since the peeling or falling of the coated resin layer off the carrier surface decreases. Further, the resin-coated carrier can maintain stable charging performance even if the environment varies. Accordingly, a developer using therein such a resin-coated carrier as above can remarkably improve in service life and image characteristics. In addition to this, the method of the present invention is excellent in economy and productivity since the heating time is short as previously mentioned.

What is claimed is:

1. A method of manufacturing a resin-coated carrier for an electrophotographic developer comprising the steps of 1) coating a resin on the surface of a carrier core, each of said resin and said carrier core being a dielectric material, to obtain a resin coated carrier;

2) baking the thus obtained resin-coated carrier by means of microwave heating with a microwave, said microwave having an agitating blade, under such conditions that the thickness of the resin-coated carrier layer being baked is in the range of from 5 to 25 mm, the number of revolutions of said agitating blade for agitating the microwave is in the range of from 20 to 40 rpm and the irradiation time is in the range of from 30 seconds to 10 minutes, to obtain the resin-coated carrier.

2. The method according to claim 1, wherein said carrier core has a particle diameter between 15 and 200 μm.

3. The method according to claim 1, wherein said resin is a member selected from the group consisting of a fluorine-based resin, a silicone-based resin, an acryl-styrene resin, an alkyd resin, a polyolefin resin, a polyester resin, a melamine-based resin and an epoxy resin, and mixtures thereof.

4. The method according to claim 1 wherein in step 1) the amount of said resin coating is 0.05–10% by weight of said resin-coated carrier.

5. The method according to claim 1, wherein said microwave is electromagnetic wave of frequency in the range of from 300 MHz to 30 GHz and has a frequency of 915±25 MHz or 2450±50 MHz.

6. The method according to claim 1, wherein said carrier core is Cu—Zn ferrite.

7. The method according to claim 1, wherein said microwave heating is carried out to heat said resin coated carrier to a temperature higher than that at which the resin is cured.

8. The method according to claim 7 wherein said carrier core is copper-zinc ferrite, said resin is a mixture of an acryl-styrene resin and a melamine-based resin and said microwave heating is carried out to heat said resin coated carrier to a temperature of 150° C.

9. The method according to claim 7 wherein said carrier core is copper-zinc ferrite, said resin is a silicone resin, and said microwave heating is carried out to heat said resin coated carrier to a temperature of 200° C.

10. The method according to claim 7 wherein the said carrier core is copper zinc ferrite, the resin is a mixture of fluorine-acryl resin, polyvinylidene fluoride and acryl-styrene resin and said microwave heating is carried out to heat said resin coated carrier to a temperature of 170° C.

11. An electrophotographic developer comprising a resin-coated carrier manufactured by the method of claim 1.

12. An electrophotographic developer comprising a resin-coated carrier manufactured by the method of claim 5.

* * * * *